US011651913B1

(12) United States Patent
Shiravi

(10) Patent No.: US 11,651,913 B1
(45) **Date of Patent: *May 16, 2023**

(54) LOCKING DEVICE FOR A TOGGLE LIGHT SWITCH

(71) Applicant: Ataollah Shiravi, Farmington Hills, MI (US)

(72) Inventor: Ataollah Shiravi, Farmington Hills, MI (US)

(73) Assignee: Mindtrade LLC, Ann Arbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/676,790

(22) Filed: Feb. 21, 2022

(51) Int. Cl.
*H01H 21/06* (2006.01)
*H01H 21/22* (2006.01)

(52) U.S. Cl.
CPC ..... *H01H 21/06* (2013.01); *H01H 21/22* (2013.01)

(58) Field of Classification Search
CPC ..... H01H 3/20; H01H 21/30; H01H 21/06; H01H 21/22; H02G 3/14
USPC ..... 200/42 R, 242, 335, 304
See application file for complete search history.

(56) References Cited

U.S. PATENT DOCUMENTS 10,354,812 B1 * 7/2019 Enger ..... H01H 9/283
11,257,642 B2 * 2/2022 Shiravi ..... H01H 9/286

* cited by examiner

*Primary Examiner* — Edwin A. Leon
*Assistant Examiner* — Iman Malakooti
(74) *Attorney, Agent, or Firm* — HeedLawGroup PLLC; Thomas P Heed

(57) ABSTRACT

A locking device for a standard toggle light switch is disclosed. The locking device has a partial rectangular cuboid member, a planar torque arm member, a planar locking member, and a locking tab with a notch. The planar locking member inserts into an interstice at the base of the rotary hub of a standard toggle light switch. The locking tab fits into another interstice along the side of the rotary hub and engages with the toggle housing, locking itself in place.

11 Claims, 8 Drawing Sheets

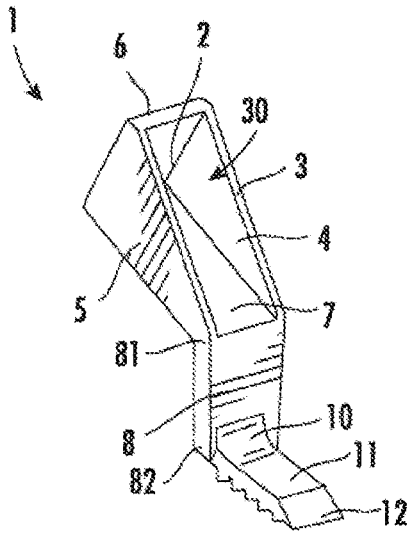
FIG. 1
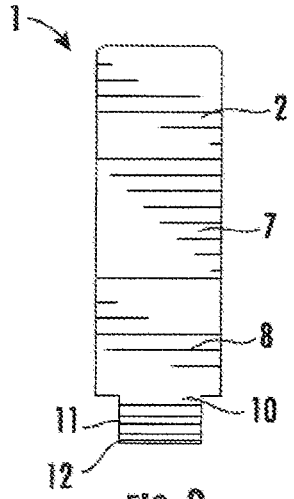
FIG. 2
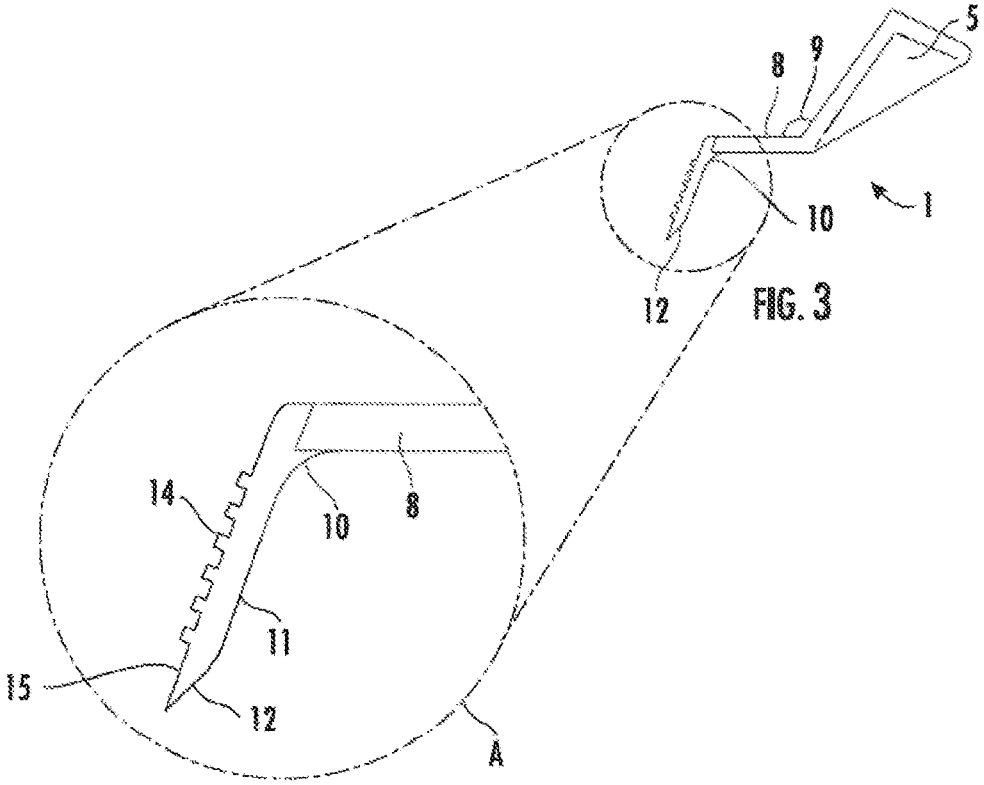
FIG. 3
FIG. 4

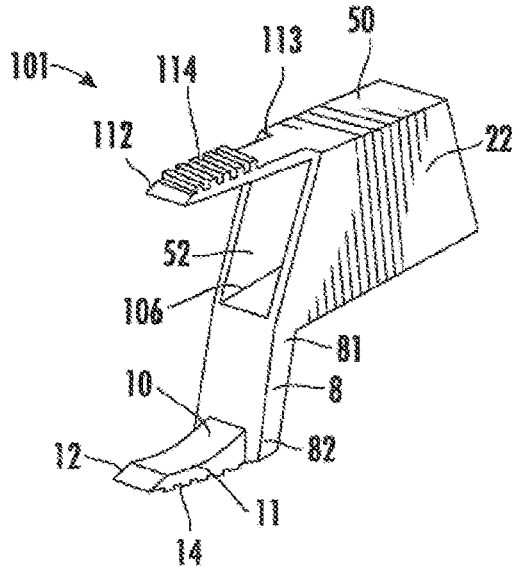
FIG. 5
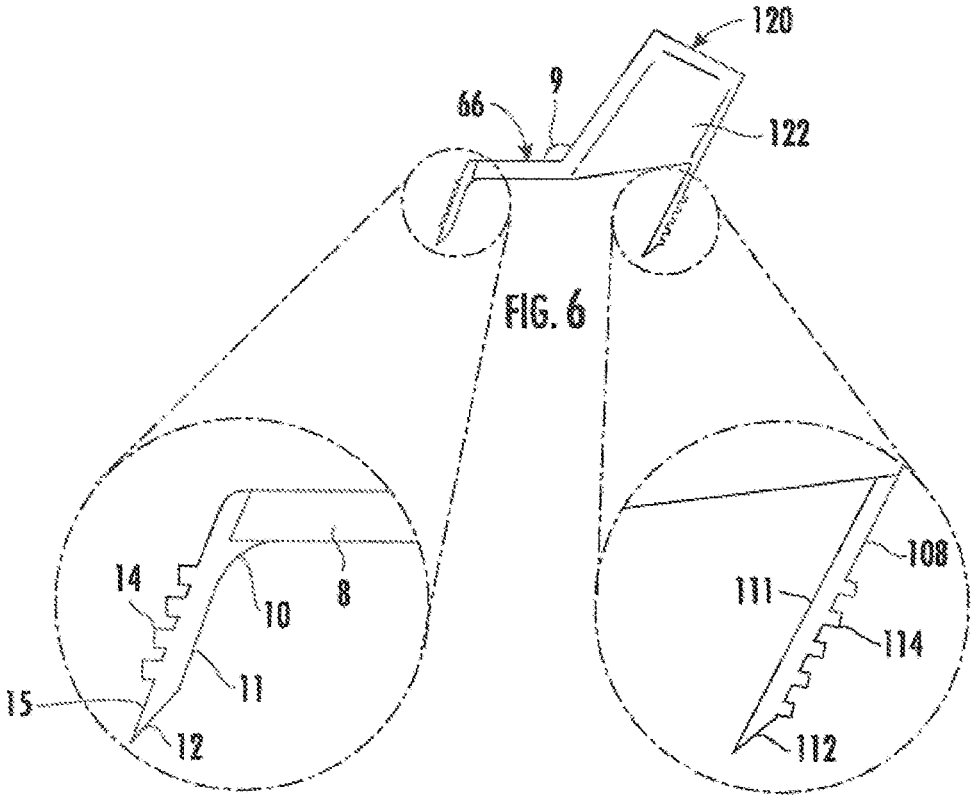
FIG. 6
FIG. 7
FIG. 8

LOCKING DEVICE FOR A TOGGLE LIGHT SWITCH

CLAIM OF PRIORITY

This U.S. non-provisional utility patent application is a continuation-in-part of U.S. non-provisional utility patent application Ser. No. 17/168,442, filed Feb. 5, 2021. U.S. non-provisional utility patent application Ser. No. 17/168,442 claimed priority to provisional utility patent application 62/983,607, filed Feb. 29, 2020.

FIELD OF INVENTION

This invention relates to classifications for electric switches and to one or more sub-classifications for interlocking, locking, or latching mechanisms. Specifically, this invention is a locking device for a standard toggle light switch.

BACKGROUND OF INVENTION

Most switches in use today are secured in an outlet box in a wall or in a machine. In the front surface of the switch are threaded holes, which receive screws that fasten a switch plate to the switch, called hereinafter switch plate screws. These switch plate screws are inserted through holes in the switch plate. An opening or cutout is provided in the switch plate through which the actuator member of the toggle switch protrudes. A problem arises with switches which control lights in areas where the lights must be kept on, or off, for periods of time, or which control other electrical devices, such as burglar alarms and security cameras, in which the toggle switch can be accidentally operated by a person.

Devices for preventing switch operation have been developed using covers or open-sided members located over the actuator member of a switch and installed to a switch plate by clips or by one or more of the switch plate screws. Such devices are described, for example, in U.S. Pat. Nos. 4,102,471, 4,363,944, 4,506,120, and U.S. Design Pat. Nos. D301,336, D301872, D351,376, and D408,018. Other devices provide an electrical switch protective cover, as described in U.S. Pat. No. 5,955,702, having a movable frame hinge-attached to a stationary frame mounted to a switch plate, where the stationary frame has an opening through which the actuator member of the switch extends into an enclosed cavity of the movable frame when closed against the stationary frame. Other types of devices for preventing operation of a switch have a plate or arm member which lies against the actuator member of a switch to prevent its operation. The plate or arm is anchored to the switch plate by one or more of the switch plate screws, such as described, for example, in U.S. Pat. Nos. 4,876,425, 4,468,544, 5,009,610 and 9,177,734, and U.S. Design Pat. No. D372,224. U.S. Pat. No. 5,324,897 shows a switch locking device having a one-piece locking body mounted by two screws to a switch plate with an opening receiving the switch to maintain the switch in a desired position. This patent also shows a mounted plate with a cutout to maintain the switch in a position. More complex locking devices mounted to a switch plate can be found in U.S. Pat. Nos. 5,260,528 and 5,543,593. U.S. Pat. No. 6,627,816 tried to attach a part to the actuating member with no bolts, but the part works like a cover only. It will be completely loose and cannot withhold any force trying to manipulate the switch.

Almost all mentioned patents describe devices which require installation by attachment to a switch plate to anchor the device to either cover the actuator member or lie against the actuator member of the switch. Such devices are often not useful with switch plate designs that lack screws or features onto which the device may attach. Moreover, installation to a switch plate using tools, such as a screwdriver, increases the possible risk of electrical shock if the switch electrically shorts. For example, through the switch plate screws, due to improper installation or a damaged switch. This can result in a hazardous condition, especially where the device is of an electrically conductive material. In addition, most of the inventions above are big and bulky and will change the appearance of the environment they are in.

What the market really needs is a snap-on light switch lock that is secure and does not require any tools for installation. A device that is flush with the light switch and blends with the home décor.

SUMMARY OF THE INVENTION

This summary is intended to disclose the present invention, a locking device for a toggle light switch. Embodiments of the invention are presented to illustrate and inform one skilled in the art.

The first embodiment of the present invention is an integral body comprised of a partial rectangular cuboid member, a planar torque arm member, and at least one planar locking member. The partial rectangular cuboid member has a top surface, exterior side surfaces, interior side surfaces, and an opening. The planar torque arm has a first end and a second end. The partial rectangular cuboid member is attached to first end of the planar torque arm member, forming an obtuse angle.

In this embodiment, the present invention has a single planar locking member. The planar locking member has a tapered first end. The second end of the planar locking member is attached to the second end of the planar torque arm. The planar locking member has an outer surface with protrusions.

The second embodiment of the present invention is an integral body comprised of a partial rectangular cuboid member, a planar torque arm member, and two planar locking members. The partial rectangular cuboid member has a top surface, exterior side surfaces, interior side surfaces, and an opening. The planar torque arm has a first end and a second end. The partial rectangular cuboid member is attached to the first end of the planar torque arm member, forming an obtuse angle.

In this embodiment, the present invention has two planar locking members. The two planar locking members each have a tapered first end. The two planar locking member each have a flat inner surface and an outer surface with protrusions. The second end of the first planar locking member is attached to the second end of the planar torque member. The second end of the second planar locking member is attached to the partial rectangular cuboid member, extending parallel from a side surface, disposed opposite to the first planar locking member.

The third embodiment of the present invention is an integral body comprised of a partial rectangular cuboid member, a pentagon-shaped locking tab extending from the partial rectangular cuboid member, a planar torque arm member, and a planar locking member. The partial rectangular cuboid member has a top surface, four exterior side surfaces, four interior side surfaces, and an opening. The planar torque arm has a first end and a second end. The partial rectangular cuboid member is attached to first end of the planar torque arm member, forming an obtuse angle. The first end of the planar torque arm member is attached to one of the exterior side surfaces at the opening.

In this embodiment, the present invention has a single planar locking member. The planar locking member has a tapered first end. The second end of the planar locking member is attached to the second end of the planar torque arm. The planar locking member has an outer surface with protrusions.

The locking tab is attached to one of the exterior side surfaces of the partial rectangular cuboid at the opening. The locking tab is attached to an exterior side surface that is adjacent to the exterior side surface to which the first end of the planar torque arm is attached. The locking tab has a pentagonal shape. The junction of the locking tab and the exterior side surface to which it is attached creates a notch.

By applying pressure on the exterior surfaces of the first embodiment of the present invention, the planar locking member will slide into an interstice between the switch plate and the rotary hub. The toggle of the switch will get inserted into the partial rectangular cuboid member. The protrusions on locking member will fill the interstice, preventing the rotary hub from rotating, thereby locking the toggle in place.

By applying pressure on the exterior surfaces of the second embodiment of the present invention, the first planar locking member will slide into an interstice between the switch plate and the rotary hub. The toggle of the switch will get inserted into the partial rectangular cuboid member. The second planar locking member will slide into an interstice between the switch plate and the switch toggle. The two planar locking members will prevent the toggle and rotary hub from moving. The protrusions on each of the locking members will fill their respective interstice.

By applying pressure on the exterior surfaces of the third embodiment of the present invention, the planar locking member will slide into an interstice between the switch plate and the rotary hub. The locking tab will slide into a separate interstice between the switch plate and the side of the rotary hub. The toggle of the switch will get inserted into the partial rectangular cuboid member. The protrusions on the locking member will fill the interstices, preventing the rotary hub from rotating, thereby locking the toggle in place. The notch in the locking tab will lock against the inner surface toggle switch housing.

BRIEF DESCRIPTION OF THE DRAWINGS

The present invention is illustrated with 21 drawings on 8 sheets. The accompanying drawings, which are incorporated in and constitute a part of this disclosure, illustrate various example embodiments. In the drawings:

FIG. 1 is a perspective view of a first embodiment of the present invention.

FIG. 2 is a front view of the first embodiment of the present invention.

FIG. 3 is a side view of the first embodiment of the present invention.

FIG. 4 is a side isolation view of a feature of the first embodiment of the present invention.

FIG. 5 is a perspective view of a second embodiment of the present invention.

FIG. 6 is a side view of the second embodiment of the present invention.

FIG. 7 is a side isolation of a first feature of the second embodiment of the present invention.

FIG. 8 is a side isolation of a second feature of the second embodiment of the present invention.

DETAILED DESCRIPTION OF THE DRAWINGS

Figure 10:
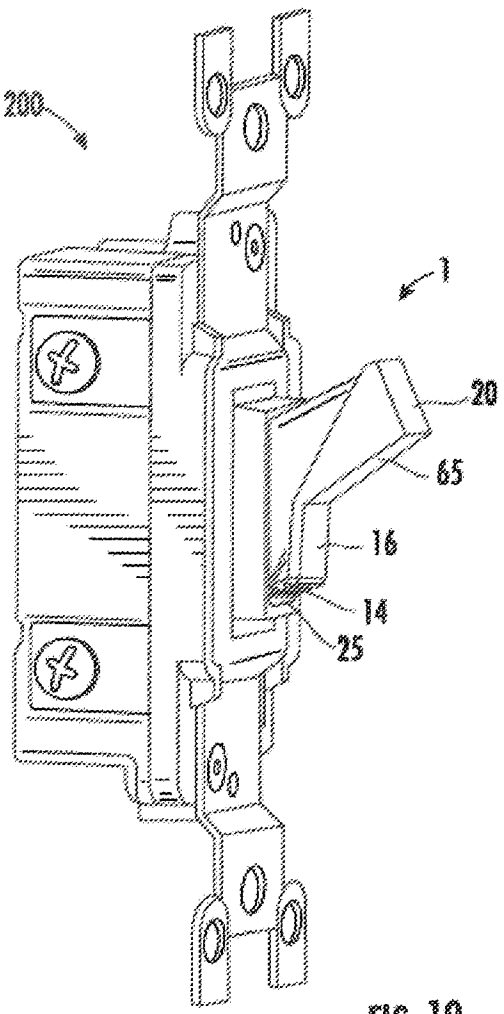
FIG. 10 is a perspective view of the first embodiment of the present invention mounted, in situ, to a standard toggle light switch.
Figure 9:
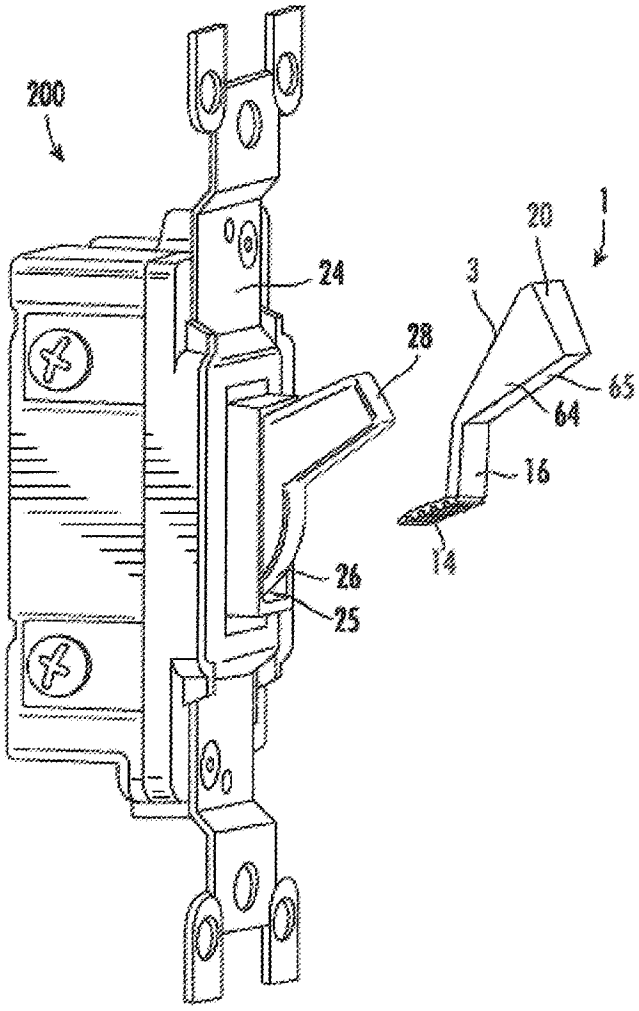
FIG. 9 is a perspective view of the first embodiment of the present invention held relative to a standard toggle light switch.

The following descriptions are not meant to limit the invention, but rather to add to the summary of invention, and illustrate the present invention, a locking device for a toggle light switch. The present invention is illustrated with a variety of drawings showing the primary embodiments of the present invention, with various diagrams and figures explaining its workings. The drawings are those needed to help one skilled in the art to understand and replicate the present invention.

Certain terminology is used in the following description for convenience only and is not limiting. The article "a" is intended to include one or more items, and where only one item is intended the term "one" or similar language is used. To assist in the description of the present invention, words such as short, long, top, bottom, side, upper, lower, front, rear, inner, outer, right and left are used to describe the relative size and orientation of the present invention, a teether, with respect to the accompanying figures. The terminology includes the words above specifically mentioned, derivatives thereof, and words of similar import.

The following detailed description refers to the accompanying drawings. Wherever possible, the same reference numbers are used across the descriptions of the drawings and embodiments to refer to the same or similar elements. The embodiments of the claimed subject matter may be described, modified, and adapted, and other implementations are possible. For example, substitutions, additions, or modifications, which, perform identical functions to the embodiments disclosed, may be made to the elements illustrated in the drawings. Accordingly, the following detailed description does not limit the claimed subject matter. The proper scope of the claimed subject matter is defined by the claims contained herein. The claimed subject matter improves over the prior art by providing a locking device for a standard toggle light switch which does not need to be mounted, or require the removal of the light switch wall plate.

FIGS. 1-4 and 9-12 illustrate a first embodiment of the present invention 1, an integral body comprised of a partial rectangular cuboid member 2, a planar torque arm member 8, and at least one planar locking member 11. The partial rectangular cuboid member 2 has a top surface 20 (shown in FIG. 9), four side surfaces 3, 5, 6 (Shown in FIG. 1), 64, 65 (shown in FIG. 9) and an opening 30. The partial rectangular cuboid member has an exterior (e.g., 3, 5, 6) and an interior (e.g., 4, 7). The planar torque arm member 8 has a first end 81, attached to the partial rectangular cuboid member 2 at the side surface 65, adjacent to the opening 30 and distal to the top surface 20; and a second end 82. The connection between the partial rectangular cuboid member 2 and the planar torque arm member 8 forms an obtuse angle 9.

In this embodiment, the present invention 1 has a single planar locking member 11. The planar locking member 11 has a tapered first end 12. The second end 10 of the planar locking member 11 is attached to the second end 82 of the planar torque arm. The planar locking member 11 has an outer surface 15 with protrusions 14.

FIGS. 5-8 and 13-16 illustrate a second embodiment of the present invention 101, an integral body comprised of a partial rectangular cuboid member 122, a planar torque arm member 8, and two planar locking members 11 and 108. The partial rectangular cuboid member 106 has a top surface 120 (shown in FIG. 5), four side exterior surfaces 22, 50 (Shown in FIG. 5), 121 (Shown in FIG. 14), 122 (shown in FIG. 6), and an opening 52. The partial rectangular cuboid member has an exterior (e.g., 22, 52, 121, 122) and an interior (e.g., 106). The planar torque arm member 8 has a first end 81, attached to the partial rectangular cuboid member at the side surface 121, adjacent to the opening 52 and distal to the top surface 120; and a second end 82. The connection between the partial rectangular cuboid member 122 and the planar torque arm member 66 forms an obtuse angle 9.

In this embodiment, the present invention 101 has two planar locking members 11 and 108. The first planar locking member 11 has a tapered first end 12. The second end 10 of the first planar locking member 11 is attached to the second end 82 of the planar torque arm. The first planar locking member 11 has an outer surface 15 with protrusions 14. The second planar locking member 108 has a tapered first end 112. The second end 113 of second planar locking member is attached to the partial rectangular cuboid 122 by extending parallel from a side surface 50, distal to the top surface 120 of the partial rectangular cuboid member 122. The second planar locking member 108 has an inner surface 111 and an outer surface with protrusions 114.

Figure 12:
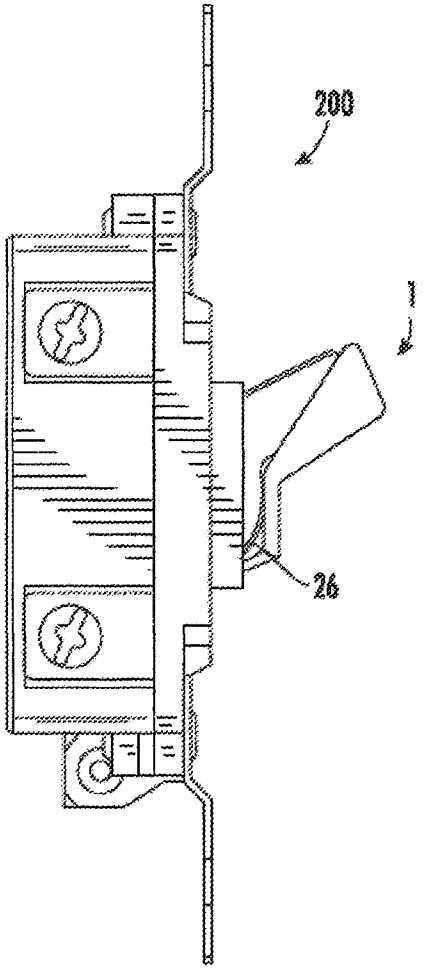
FIG. 12 is a side view of the first embodiment of the present invention mounted, in situ, to a standard toggle light switch.
Figure 11:
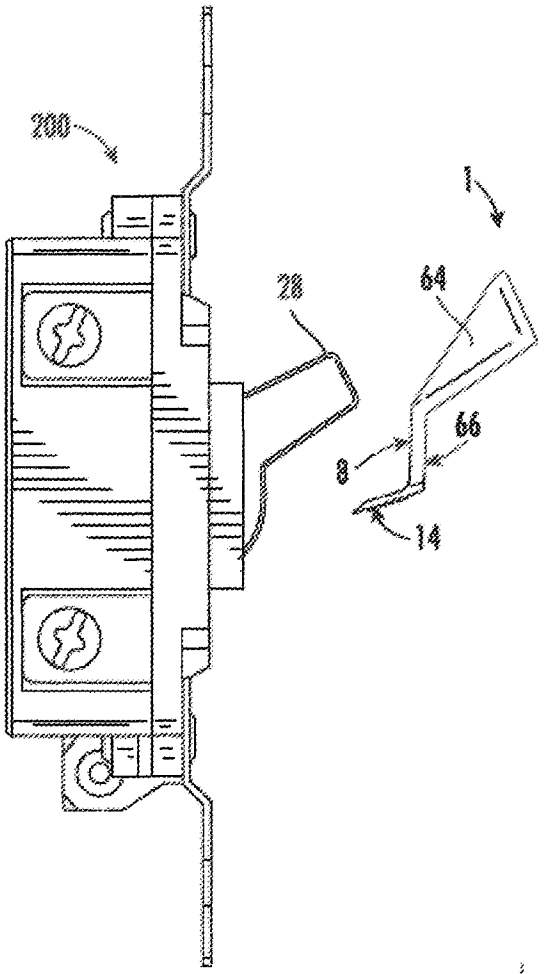
FIG. 11 is a side view of the first embodiment of the present invention held relative to the standard toggle light switch.
Figure 14:
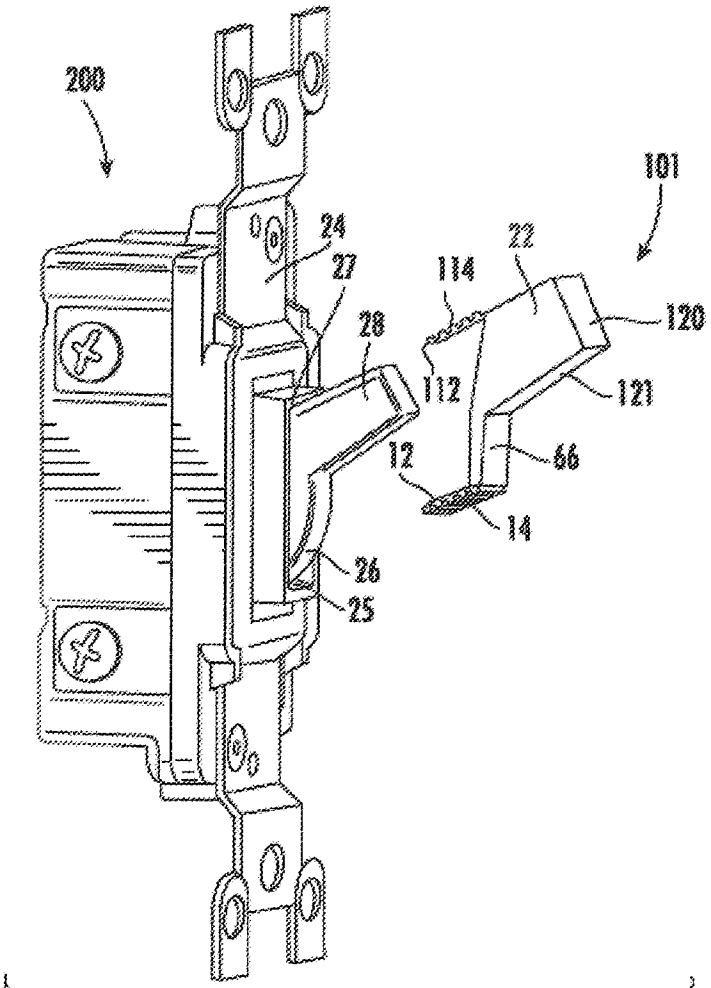
FIG. 14 is a perspective view of the second embodiment of the present invention held relative to the standard toggle light switch.
Figure 13:
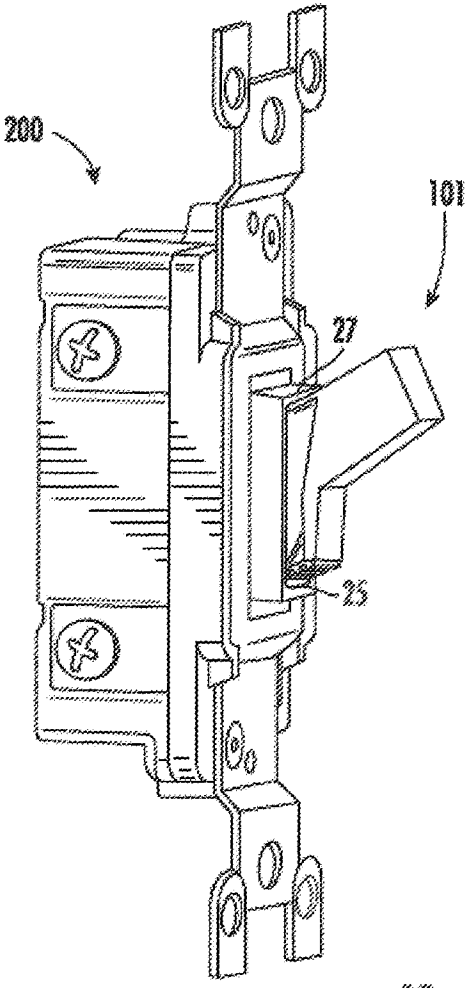
FIG. 13 is a perspective view of the second embodiment of the present invention mounted, in situ, to a standard toggle light switch.
Figure 16:
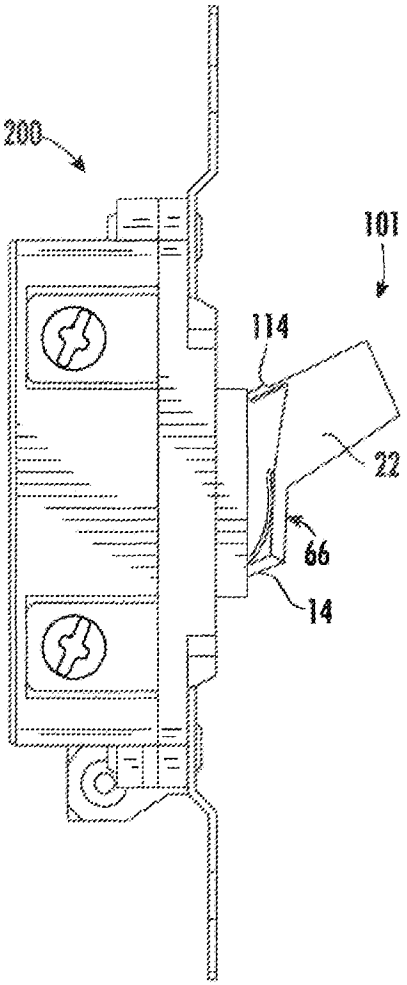
FIG. 16 is a side view of the second embodiment of the present invention mounted, in situ, to a standard toggle light switch.
Figure 15:
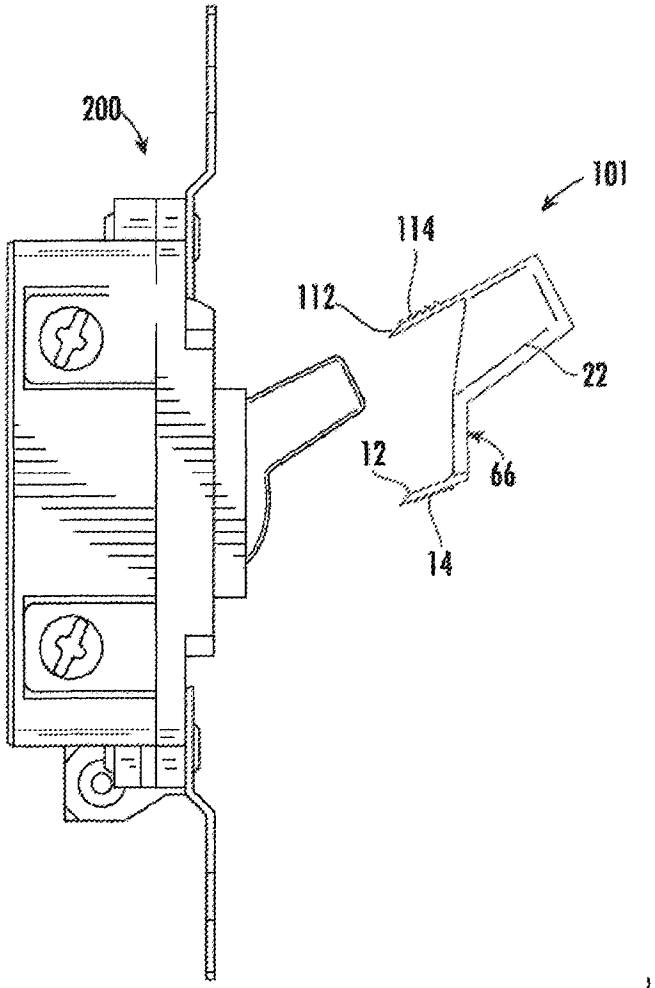
FIG. 15 is a side view of the second embodiment of the present invention held relative to the standard toggle light switch.
Figure 17:
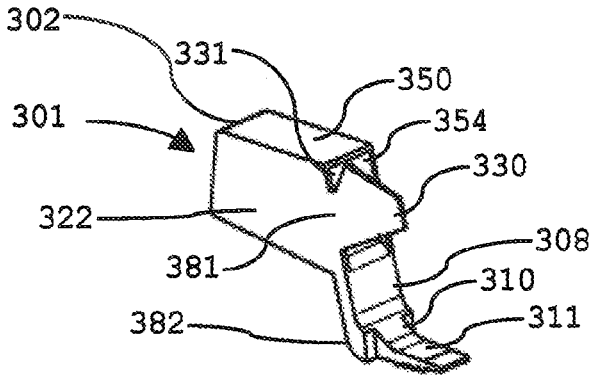
FIG. 17 is a perspective view of a third embodiment of the present invention.
Figure 18:
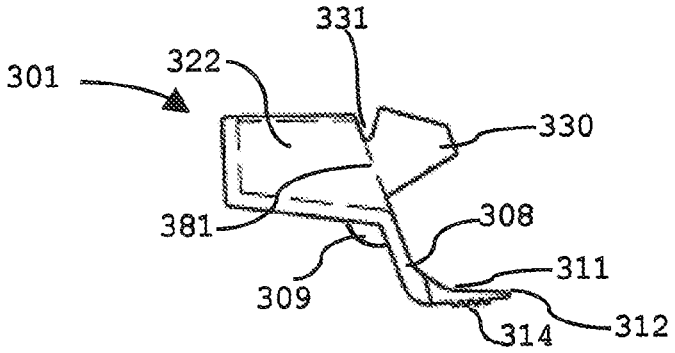
FIG. 18 is a reverse perspective view of the third embodiment of the present invention.
Figure 19:
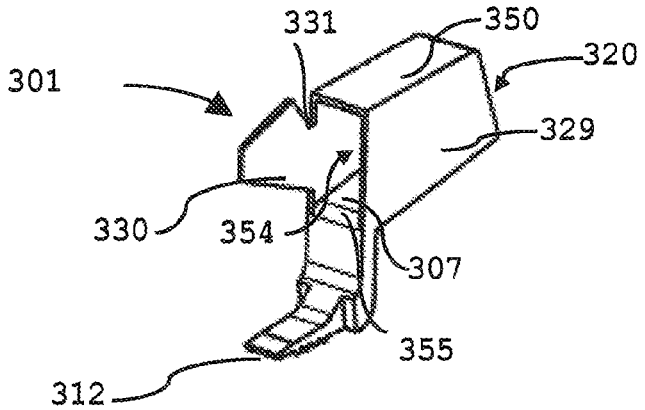
FIG. 19 is a side view of the third embodiment of the present invention.

FIGS. 9-12 illustrate a first embodiment of the present invention 1, and the standard toggle light switch 200 having a mounting body 24, before installation (shown in FIG. 9 and FIG. 11) and after installation (shown in FIG. 10 and FIG. 12).

By applying pressure on the surface 16 of the present invention 1, the single planar locking member 11 will slide into the interstice 25 at the base of the rotary hub 26. and the switch toggle 28 gets inserted into partial rectangular cuboid member 2 through opening 30. The protrusions 14 on locking member 11 will fill the interstice 25 at the base of the rotary hub 26 and lock the toggle 28 in place.

FIGS. 13-16 illustrate the second embodiment of the present invention 101, and the standard toggle light switch 200 having a mounting body 24, before installation (shown in FIG. 9 and FIG. 11) and after installation (shown in FIG. 10 and FIG. 12).

By applying pressure on the surface 66 and 120 the present invention 101, the two planar locking member 11 and 108 will be positioned to lock the toggle 28 in place. The first planar locking member 11 slides into a first interstice 25 at the base of the rotary hub 26. The second planar locking member 108 slides into a second interstice 27 near the toggle 28. The toggle 28 gets inserted into partial rectangular cuboid member 122 through opening 52. The protrusions 14 on locking member 11 will fill the interstice 25. The protrusions 114 on locking member 108 will fill the interstice 27. The toggle 28 will thus be locked the toggle in place.

FIGS. 17-21 illustrate a third embodiment of the present invention 301, an integral body comprised of a partial rectangular cuboid member 302, a planar torque arm member 308, a locking tab 330 extending from a side surface 322 of the partial rectangular cuboid member 302, and a planar locking member 311. The partial rectangular cuboid member 302 has a top surface 320 (shown in FIG. 21), four side surfaces 322, 329, 350, 307 and an opening 354. The partial rectangular cuboid member has an exterior (e.g., 322, 329, 350, 320) and an interior (e.g., 307). The planar torque arm member 308 has a first end 355, attached to the partial rectangular cuboid member 302 at the side surface 307, adjacent to the opening 354 and distal to the top surface 320; and a second end 382. The connection between the partial rectangular cuboid member 302 and the planar torque arm member 308 forms an obtuse angle 309.

In this embodiment, the present invention 301 has a single planar locking member 311. The planar locking member 311 has a tapered first end 312. The second end 310 of the planar locking member 311 is attached to the second end 382 of the planar torque arm. The planar locking member 311 has an outer surface with protrusions 314.

The locking tab 330 is pentagon-shaped. The locking tab 330 joins the side surface 322 of the partial rectangular cuboid member 302 at a junction 381, which forms a notch 331.

Figure 20:
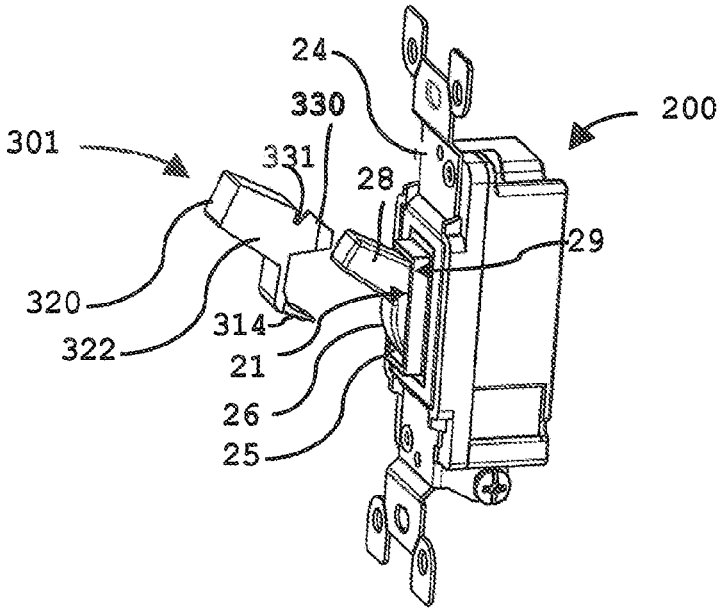
FIG. 20 is a perspective view of the third embodiment of the present invention held relative to the standard toggle light switch.
Figure 21:
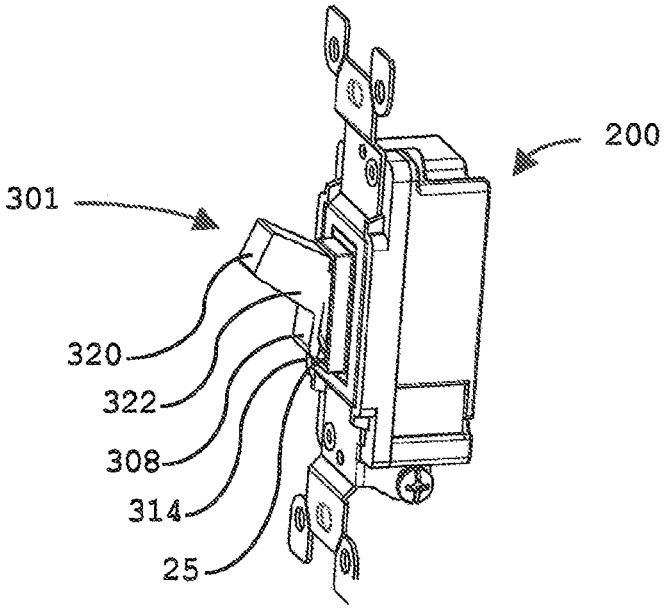
FIG. 21 is a perspective view of the third embodiment of the present invention mounted, in situ, to a standard toggle light switch.

FIGS. 20-21 illustrate the third embodiment of the present invention 301 being attached to a standard toggle light switch 200 having a mounting body 24, before installation (shown in FIG. 20) and after installation (shown in FIG. 21).

By applying pressure on the surface 308 of the planar torque arm member 308 of the present invention 301, the single planar locking member 311 will slide into the interstice 25 at the base of the rotary hub 26. The switch toggle 28 inserts into the partial rectangular cuboid member 302 through the opening 354. The protrusions 314 on locking member 311 fill the interstice 25 at the base of the rotary hub 26 and lock the toggle 28 in place. The locking tab 330 inserts into another interstice 21 at the side of the rotary hub 26. When fully inserted, the notch 331 of the locking tab 330 will lock against the toggle switch housing 29.

The first 1, second 101, and third 301 embodiments of the current invention 1, 101, 301 have an integral body that can be fabricated from at least one of polyvinyl chloride ("PVC"), polypropylene ("PP"), acrylonitrile butadiene styrene ("ABS"), polycarbonate ("PC"), nylon, high-density polyethylene ("HDPE"), low-density polyethylene ("LDPE"), polyethylene terephthalate ("PET") and a thermoplastic elastomer ("TPE").

Embodiments described above with reference to functions or acts, comprise methods. The functions/acts noted above may occur out of the order as shown or described. For example, two functions/acts shown or described in succession may in fact be executed substantially concurrently or the functions/acts may sometimes be executed in the reverse order, depending upon the functionality/acts involved. While certain embodiments have been described, other embodiments may exist. Further, the disclosed methods' functions/acts may be modified in any manner, including by reordering functions/acts and/or inserting or deleting functions/acts, without departing from the spirit of the claimed subject matter.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

I claim:

1. A locking device for a toggle light switch comprising:

a partial rectangular cuboid member having a top surface, four side surfaces, an interior, an exterior, and an opening disposed distal to the top surface;

a planar torque arm member having a first end, attached to the partial rectangular cuboid member near the opening, and a second end;

at least one planar locking member having a tapered first end, a surface with a plurality of protrusions, and a second end; and a locking tab having a notch and extending from a first side surface of the partial rectangular cuboid member at the opening, distal to the top surface;

wherein the partial rectangular cuboid member is sized and shaped so that it mates with a standard toggle light switch, having a toggle, a rotary hub, an opening exposing the toggle and rotary hub, an interstice on the side of the rotary hub, and a toggle housing by fitting over and capturing the toggle in the interior of the partial rectangular cuboid member;

wherein the at least one locking member locks the toggle and rotary hub in place by inserting the tapered first end of the planar locking member between the rotary hub and the opening exposing the toggle and rotary hub until the plurality of protrusions of the planar locking member are wedged into an interstice between the rotary hub and the opening exposing the toggle and rotary hub, preventing the rotary hub from rotating; and wherein the locking tab further locks the toggle and rotary hub in place by inserting into the interstice at the side of the rotary hub and having the notch lock to the toggle housing.

2. The locking device for a toggle light switch in claim 1, wherein the partial rectangular cuboid member is capable of mating with a standard toggle light switch regardless of the orientation of the toggle.

3. The locking device for a toggle light switch in claim 2, wherein the locking device is flush mountable on a standard toggle light switch.

4. The locking device for a toggle light switch in claim 3, wherein the second end of the one planar locking member is attached to the second end of the planar torque arm member.

5. The locking device for a toggle light switch in claim 4, wherein the planar torque arm member attaches to the partial rectangular cuboid near the opening at the end of a second side surface, distal to the top surface, making an obtuse angle with the second side surface.

6. The locking device for a toggle light switch in claim 5, wherein the second end of the first planar locking member is attached to the second end of the planar torque arm member.

7. The locking device for a toggle light switch in claim 6, wherein the first side surface is adjacent to the second side surface.

8. The locking device for a toggle light switch in claim 7, wherein the locking tab is a pentagonal surface.

9. The locking device for a toggle light switch in claim 1, wherein the partial rectangular cuboid member, the planar torque arm member, the locking tab, and the planar locking member are fabricated as an integral body.

10. The locking device for a toggle light switch in claim 9, wherein the integral body is fabricated from an electrical insulator.

11. The locking device for a toggle light switch in claim 10, wherein the integral body is fabricated from at least one of polyvinyl chloride ("PVC"), polypropylene ("PP"), acrylonitrile butadiene styrene ("ABS"), polycarbonate ("PC"), nylon, high-density polyethylene ("HDPE"), low-density polyethylene ("LDPE"), polyethylene terephthalate ("PET") and a thermoplastic elastomer ("TPE").

* * * * *